US006690896B2

(12) United States Patent
Hanada et al.

(10) Patent No.: US 6,690,896 B2
(45) Date of Patent: Feb. 10, 2004

(54) IMAGE FORMING APPARATUS, REPLACEMENT ASSEMBLY FOR IMAGE FORMING APPARATUS AND INTEGRATED CIRCUIT CHIP THEREFOR

(75) Inventors: Motonori Hanada, Kanagawa (JP); Jun Hosokawa, Tokyo (JP); Kouta Fujimori, Kanagawa (JP); Kazuhiko Yuuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 13 days.

(21) Appl. No.: 10/023,862

(22) Filed: Dec. 21, 2001

(65) Prior Publication Data

US 2002/0085848 A1 Jul. 4, 2002

(30) Foreign Application Priority Data

Dec. 26, 2000 (JP) ..... 2000-394988
Dec. 26, 2000 (JP) ..... 2000-394990
Dec. 4, 2001 (JP) ..... 2001-369812

(51) Int. Cl.[7] ..... G03G 15/08
(52) U.S. Cl. ..... 399/27
(58) Field of Search ..... 399/27, 24, 29, 399/79, 10, 12–13

(56) References Cited

U.S. PATENT DOCUMENTS 5,204,698 A 4/1993 LeSueur et al. ..... 347/140
5,784,669 A 7/1998 Miura et al.
5,915,155 A 6/1999 Shoji et al.
6,122,469 A 9/2000 Miura et al.
6,125,243 A 9/2000 Shoji et al.

FOREIGN PATENT DOCUMENTS

| | | |
|---|---|---|
| EP | 0 840 182 | 5/1998 |
| EP | 1 055 979 | 11/2000 |
| JP | 54-24638 | 2/1979 |
| JP | 60-239778 | 11/1985 |
| JP | 4-251880 | 9/1992 |
| JP | 10-20650 | 1/1998 |
| JP | 11-65255 | 3/1999 |
| JP | 11-65261 | 3/1999 |
| JP | 2000-181214 | 6/2000 |

*Primary Examiner*—Quana M. Grainger
(74) *Attorney, Agent, or Firm*—Oblon, Spivak, McClelland, Maier & Neustadt, P.C.

(57) ABSTRACT

The present invention provides an electro photographic image forming apparatus comprising a replacement assembly having a toner container attachable to the image forming apparatus, a feeding unit to feed toner from the toner container to a development unit, and a read/write non-volatile memory, wherein, the image forming apparatus comprising an estimation unit which generates information in such way that first, the estimation unit obtains an amount of a toner feed period for the feeding unit during forming images, next, accumulates the amount of a toner feed period into an accumulated sum of the amount of a toner feed periods, then, generates the information on the amount of toner in the replacement assembly and stores the information in the read/write non-volatile memory.

20 Claims, 11 Drawing Sheets

IMAGE FORMING APPARATUS, REPLACEMENT ASSEMBLY FOR IMAGE FORMING APPARATUS AND INTEGRATED CIRCUIT CHIP THEREFOR

BACKGROUND OF THE INVENTION

1. Field of the Invention

The present invention generally relates to an image forming apparatus, such as a printer, a copy machine, a facsimile which can form an image using an electro photographic method, and more particularly to a replacement assembly for the image forming apparatus, which is attachable to a main body of the image forming apparatus and is able to determine the quantity of toner in a toner container, such as a toner cartridge, and an integrated circuit chip therefor.

2. Description of the Related Art

Conventionally, a toner cartridge or a toner bottle for the image forming apparatus, such as a printer which forms images using an electro photographic method, is supplied as one of the replacement parts, which enables a user to replace the toner cartridge or the toner bottle.

It is desirable to have a measuring method to know the amount of unused toner in the toner cartridge so that the cartridge can be replaced at a proper time before the toner cartridge becomes empty so as not to damage the quality of the printed image.

To meet this demand, conventionally, a detector for detecting the amount of the unused toner, such as a toner sensor, is used. For example, the detector which has a light source and a photo detector inside the toner bottle is in practical use and a detection method in which the amount of unused toner in the toner bottle is detected using a sound wave is also proposed.

Further, another detection method in which a density sensor placed at the bottom of a toner tank in a development unit to which the toner is supplied from the toner cartridge is also proposed. In this method, an empty toner bottle is detected when an output of the density sensor becomes greater than a predetermined threshold value, because the less the toner remaining in the toner cartridge, the lower becomes the toner density at the bottom of the toner tank, and as a result of it, the output value from the inversely proportional density sensor is increased.

However, the former method in which a detector for detecting the amount of the unused toner is used results in a complicated construction of the main body which holds the toner bottle or a complicated construction of the toner bottle itself. This raises the cost of the image forming apparatus and the replacement assembly. Further, if the detector becomes inoperable, the amount of the unused toner can not be calculated accurately.

The latter method in which the density sensor is placed at the bottom of a toner tank in a development unit, poses a problem of a mis-detection. A fluctuation of the amount of used toner depending on a printing speed or contents of images, and furthermore a delay of feeding the toner cause a fluctuation of the toner density. As a result, the toner density is mis-detected and then this mis-detection causes a fluctuation of the sensor output because the density sensor placed at the bottom of the toner tank only detects a local density.

FIG. 13 shows output samples from the sensor under these conditions in the prior art. FIG. 13 shows a fluctuation of sampled values of the sensor output for each color (Y: yellow, M: Magenta, C: Cyan and K: Black) in every page when color images are printed. A horizontal axis shows sampling points and a vertical axis shows the sensor output voltage V. The lower the density becomes, the greater the output voltage becomes. FIG. 13 shows the fluctuations of the sensor output causing the fluctuations of the toner density under regular conditions. For example, M becomes higher than 3 V at a sampling point around 73. This is caused by a condition where little unused toner remains in the toner tank and the toner density is gradually decreasing. Therefore, if the threshold value of toner is set to 3 V, then the end of the toner will be indicated in spite of toner remaining in the toner tank.

SUMMARY OF THE INVENTION

It is a general object of the present invention to provide an image forming apparatus in which the above disadvantages are eliminated using a means for calculating the amount of the unused toner in a toner bottle. In the image forming apparatus which has a replacement assembly for the image forming apparatus, such as a toner cartridge, which is attachable to a main body of the image forming apparatus, an exact amount of the unused toner in a toner cartridges is monitored without using a conventional toner end sensor in the toner cartridge.

To meet the above mentioned demand, according to the present invention, each period for feeding toner into a development unit in the main body of the image forming apparatus from the toner container is accumulated. Then, the amount of the unused toner remaining in the toner bottle is estimated based on the total accumulated period. Further, it is another object of the present invention to provide an image forming apparatus which can adapt to a printing speed even if it is changed. Therefore, according to the present invention, it is possible to estimate the exact amount of the unused toner remaining in the toner bottle even if the feeding speed of the toner is changed according to the printing speed. Further, it is another object of the present invention to provide an image forming apparatus which can efficiently manage information pertaining to the amount of the unused toner for each toner bottle among a plurality of the toner bottles, a replacement assembly for such an image forming apparatus and an integrated circuit chip therefor.

Further, it is another object of the present invention to provide an image forming apparatus which can exactly detect an end of the toner, that is, when all the toner has been used, without causing a mis-detection even if a conventional toner density sensor placed at the bottom of a toner tank in a development unit is used.

To meet the above mentioned demand, according to the present invention, the end of the toner is detected using the conventional toner density sensor placed at the bottom of a toner tank after the above mentioned total accumulated period for feeding the toner is increased over a predetermined threshold value.

Further, it is another object of the present invention to provide an image forming apparatus which can adapt to a changing printing speed. Therefore, according to the present invention, it is possible to estimate the exact amount of the unused toner remaining in the toner bottle even if the feeding speed of the toner is changed according to the printing speed. Further, it is another object of the present invention to provide an image forming apparatus which can efficiently manage the information pertaining to the amount of the unused toner for each toner bottle among a plurality of toner bottles, a replacement assembly for such an image forming apparatus and an integrated circuit chip therefor.

The above objects of the present invention are achieved by an electro photographic image forming apparatus comprising:

a replacement assembly having a toner container attachable to the image forming apparatus;

a feeding unit to feed toner from the toner container to a development unit; and a read/write non-volatile memory;

wherein, the image forming apparatus comprising:

an estimation unit which generates information in such way that first, the estimation unit obtains an amount of a toner feed period for the feeding unit during forming images, next, accumulates the amount of a toner feed period into an accumulated sum of the amount of a toner feed periods, then, generates the information on the amount of toner in the replacement assembly and stores the information in the read/write non-volatile memory.

According to the invention, the exact information on the replacement assembly can be managed without a complicated construction of the main body or the toner bottle itself and without raising the cost. As a result, this enables proper management of the replacement assemblies according to the present invention.

The above objects of the present invention are achieved by an electro photographic image forming apparatus comprising:

a replacement assembly having a toner container attachable to the image forming apparatus;

a feeding unit to feed toner from the toner container to a development unit;

a toner detection unit which detects a density of the toner in the development unit and detects that all the toner is used in that the toner container is completely empty; and a read/write non-volatile memory;

wherein, the image forming apparatus comprising:

an estimation unit which generates information in such way that first, the estimation unit obtains an amount of the toner feed periods for the feeding unit during forming images, next, accumulates the amount of the toner feed period into an accumulated sum of the amount of a toner feed periods, then stores the accumulated sum in the read/write non-volatile memory and causes the toner detection unit to start detecting the amount of the toner contained in the toner container after the accumulated sum exceeds a predetermined threshold value.

According to the present invention, an end of the toner is calculated exactly without causing a mis-detection even if a conventional toner density sensor placed at the bottom of a toner tank in a development unit is used. As a result, this enables the management of the replacement assemblies according to the present invention.

The above objects of the present invention are achieved by the image forming apparatus, wherein the image forming apparatus is able to operate under a plurality of image forming conditions, when a linear velocity for feeding the toner is changed according to the image forming condition, the estimation unit compensates for the amount of the toner used during a feed period during forming images according to the changed linear velocity.

The above objects of the present invention are also achieved by the image forming apparatus, wherein the estimation unit separately stores each accumulated sum for each linear velocity in the read/write non-volatile memory.

According to the present invention, an exact estimate of the amount of the toner is provided when the image forming apparatus is able to operate under a plurality of image forming conditions.

The above objects of the present invention are achieved by the image forming apparatus, wherein the estimation unit calculates a sole accumulated sum from a plurality of the compensated amounts of toner used during the feed period for a plurality of linear velocities.

According to the present invention, it is possible to reduce a memory area to store information on the accumulated sum.

The above objects of the present invention are achieved by the image forming apparatus, wherein the read/write non-volatile memory is placed in the replacement assembly.

According to the invention, it is possible to store information on the amount of the toner in each toner bottle and to properly manage the data for each bottle.

The above objects of the present invention are achieved by an IC chip attachable to an electro photographic image forming apparatus, the IC chip having a read/write non-volatile memory which is connected to a CPU in the electro photographic image forming apparatus when the IC chip is attached to the electro photographic image forming apparatus and is controlled by the CPU, wherein an accumulated sum of an amount of toner feed periods during which toner is supplied from a toner container to a development unit in the image forming apparatus, is stored in the read/write non-volatile memory, the accumulated sum is read from the read/write non-volatile memory when the IC chip is attached to the image forming apparatus, the accumulated sum read from the read/write non-volatile memory is transferred to a main body of the image forming apparatus, a new accumulated sum of the amount of the toner feed periods is calculated when the toner is supplied from a toner container to a development unit in the image forming apparatus, and the new accumulated sum is rewritten over the accumulated sum which is already stored in the read/write non-volatile memory.

The above objects of the present invention are also achieved by the IC chip as claimed in claim 7, wherein the IC chip separately stores each accumulated sum for each linear velocity in the read/write non-volatile memory.

According to the present invention, it is possible to store information pertaining to the amount of the toner in the IC chip as a removable media. As a result, it is possible to properly manage information on the amount of the toner for each user of the IC chip as the removable media.

The above objects of the present invention are achieved by a replacement assembly having a toner container attachable to the image forming apparatus comprising the IC chip.

According to the invention, it is possible to store information on the amount of the toner in the toner container and to properly manage the data for each toner container.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Next, an embodiment according to the present invention will be explained with reference to accompaning figures.

Figure 1:
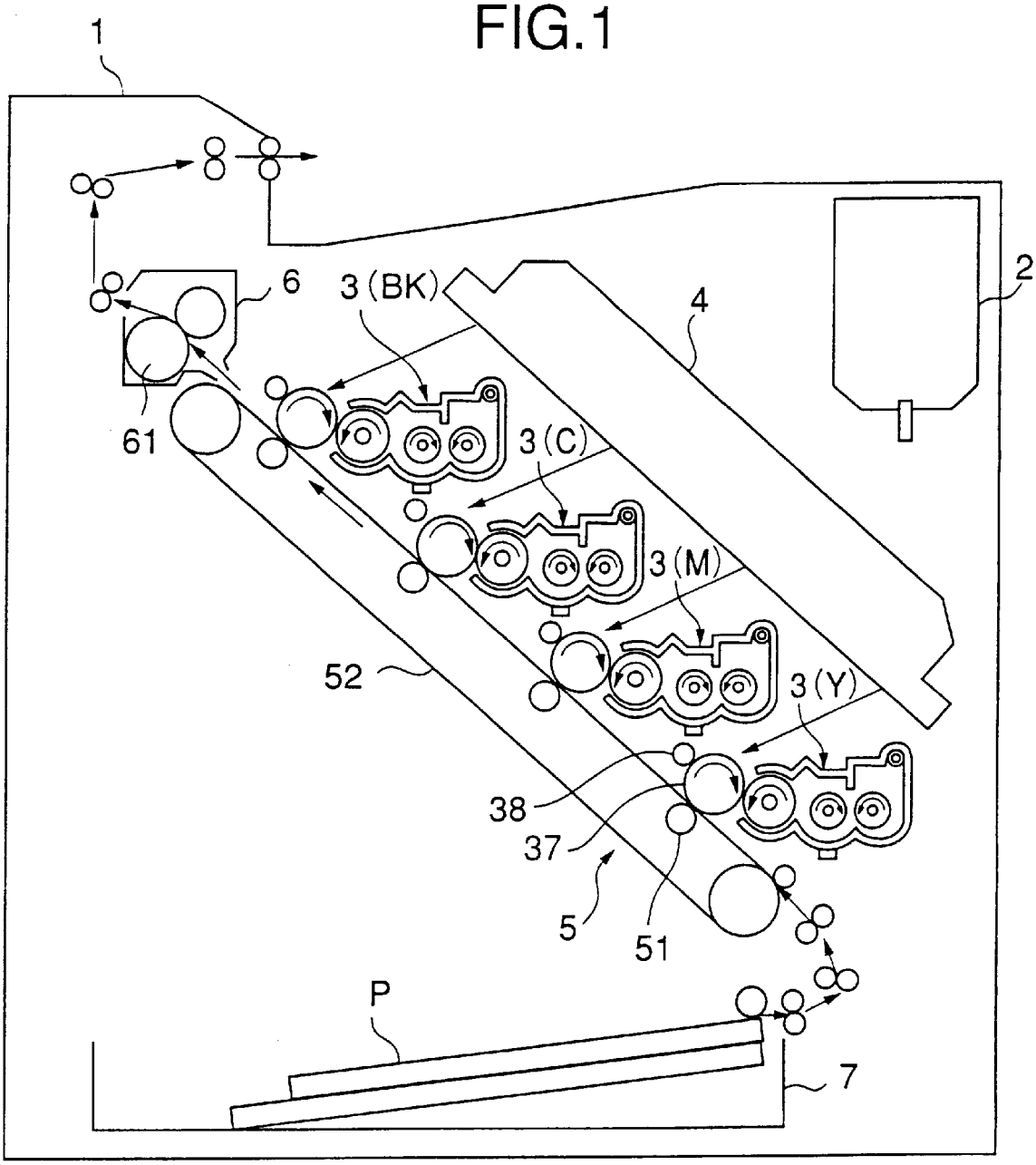
FIG. 1 shows a schematic diagram of an image forming apparatus according to an embodiment of the present invention.

FIG. 1 shows a schematic diagram of an image forming apparatus according to an embodiment of the present invention. The image forming apparatus 1 prints out color images in tandem. A detachable toner bottle 2 as a toner cartridge is attached to the image forming apparatus 1. It is one object of the present invention to properly calculate the amount of the unused toner remaining in the toner bottle and when there is no more.

The outline of the image forming apparatus will be explained with reference to FIG. 1. The image forming apparatus 1 has a development unit 3, a photosensitive unit 37, a charged roller 38, an optical writing unit 4, a transfer unit 5, a fixing unit 6 and a paper feeding unit 7. The image forming apparatus 1 has four kinds of development units 3, one for each of four colors (Y: yellow, M: magenta, C: cyan, BK: black) because of employing a tandem printing method for printing the color image. Therefore, the image forming apparatus 1 also has four photosensitive units 37, four charged rollers 38 and four transfer rollers 51 for the four colors.

The optical writing unit 4 exposes each photosensitive unit 37 with a light (laser) beam which is modulated by image data for each color and writes the image on the photosensitive unit 37 using raster scanning. The optical writing unit 4 has a polygon motor, a polygon mirror, an fθ lens, a laser diode, a mirror, and so on.

Next, the image forming operation will be explained with reference to FIG. 1. Arrows in FIG. 1 show a movement path for a transfer paper P. The transfer paper P in the paper feeding unit 7 is transported to the photosensitive unit 37 by means of a transport belt 52. The photosensitive unit 37 rotates clockwise and its surface is charged by the charged roller 38. Then, the optical writing unit 4 exposes the laser beam on the photosensitive unit 37 and the electrostatic latent image is formed on the photosensitive unit 37. This latent image on the photosensitive unit 37 is developed by toner in the development unit 3. The visible image on the photosensitive unit 37 is transferred to the recording paper P at the photosensitive unit 37 by the transfer rollers 51. Then, procedures described above are repeated by each photosensitive unit 37 for four colors. After the procedure for four colors is finished, the recording paper P is transported to the fixing unit 6 and the visible image is fixed by the fixing roller 61. Then, the recorded paper P is transferred out of the image forming apparatus 1.

Next, the construction of the toner bottle 2 as a toner cartridge and the development unit 3 and their operation will be explained.

A toner bottle 2 for the development unit 3 for each color is attached to the main body of the image forming apparatus 1 and each toner bottle is detachable. The toner in each toner bottle 2 is fed into each development unit 3 through each tube. An amount of the unused toner remaining in the toner bottle 2 is estimated by means of a method according to the present invention, which is precisely described later, and the end of the toner, that is, when there is no more toner in the toner bottle, is calculated based on the estimated amount of the unused toner before the toner is completely used. This enables the timely replacement of the toner bottle. Otherwise, the decision time to detect the end of the toner by the density sensor is limited based on the estimated amount of the unused toner. As a result, according to the present invention, the time to replace the toner bottle is exactly calculated and therefore, the high quality image printed on the recording parer is maintained.

Figure 2:
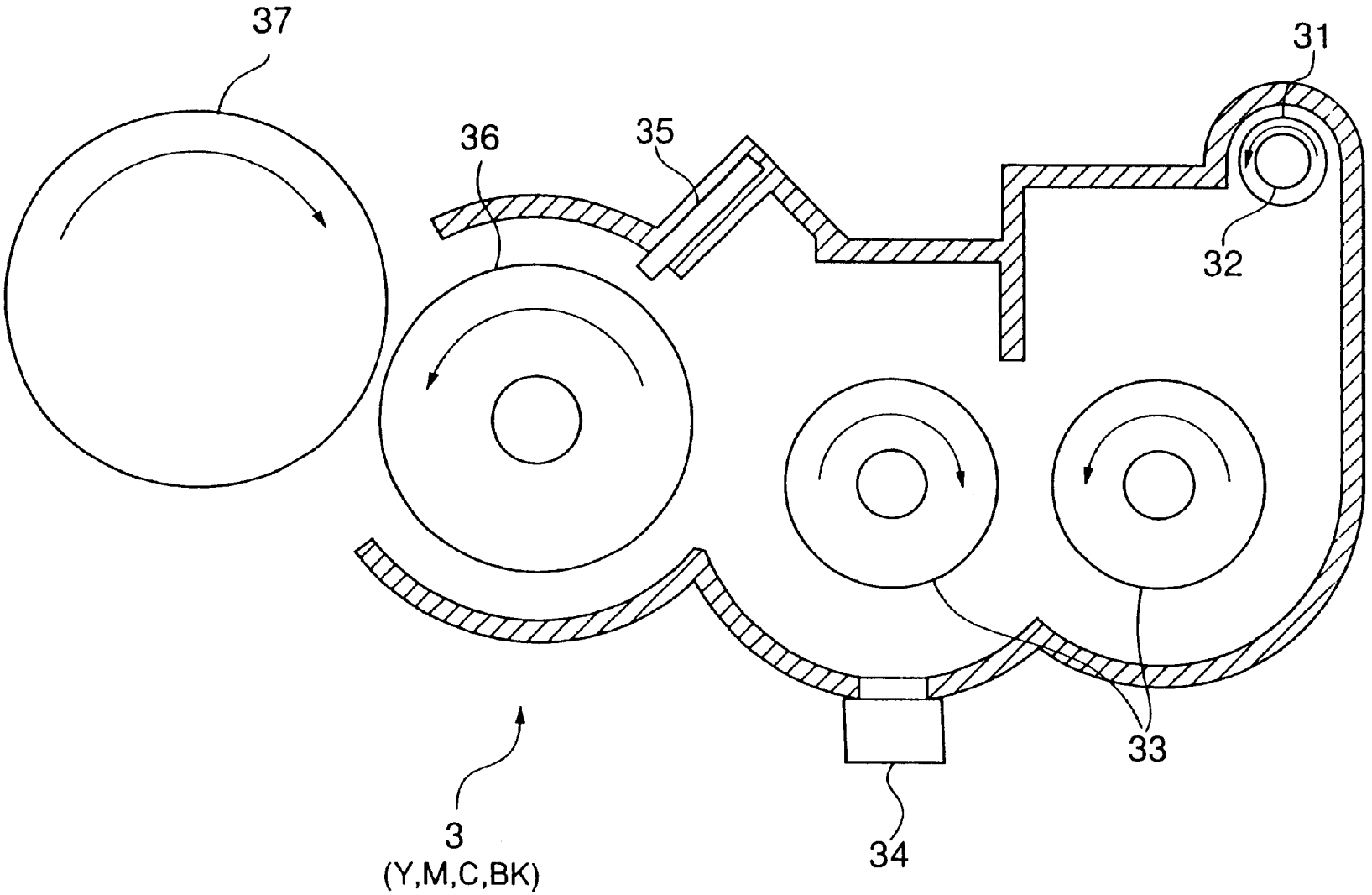
FIG. 2 shows a detail of the development unit of the image forming apparatus shown in FIG. 1 according to an embodiment of the present invention.

FIG. 2 shows a detail of the development unit 3. As shown in FIG. 2, the development unit 3 has a toner supply pump 31, mixing screws 33, a toner density sensor 34, a toner regulation unit 35 and a development sleeve 36.

The toner is fed into the development unit 3 by the toner supply pump 31 through the tube connected to the toner bottle, which is not shown, and a toner access 32. The fed toner is mixed by the mixing screws 33 and then it is passed to the development sleeve 36. The toner density at the bottom of the toner tank is detected by the toner density sensor 34 placed at the bottom of the toner tank. The detected toner density is used to control feeding of the toner and to calculate the end of the toner, which will be precisely described later.

The toner bottle 2 in the image forming apparatus 1 of the present embodiment has a read/write non-volatile memory for storing various kinds of data, which is referred to as a cartridge memory.

Figure 4:
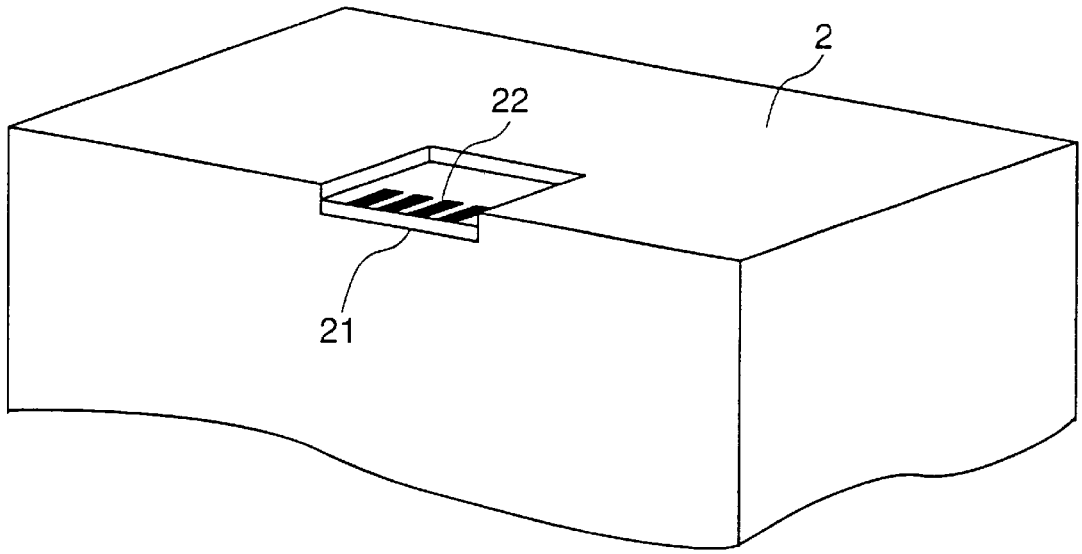
FIG. 4 shows the cartridge memory attached to the toner bottle according to the present invention.

FIG. 4 shows the cartridge memory attached to the toner bottle. As shown in FIG. 4, the toner bottle 2 has a circuit board 21 on which an IC chip of the cartridge memory is provided and a connector part 22 which connects the cartridge memory to the image forming apparatus 1. An accumulated period for feeding the toner, data of the amount of the used toner, data of the amount of the unused toner, and so on are stored in the cartridge memory. Then, the data for such items, which varies according to operational conditions of the image forming apparatus 1, is read from or written to the cartridge memory.

A control operation for reading the data from or writing the data to the cartridge memory is executed by a CPU in a control unit of the CPU. Therefore, on attaching the toner bottle 2 to the main body of the image forming apparatus 1, the cartridge memory is directly connected to the CPU in the control unit in the main body of the image forming apparatus 1 through the connector part 22.

Figure 5:
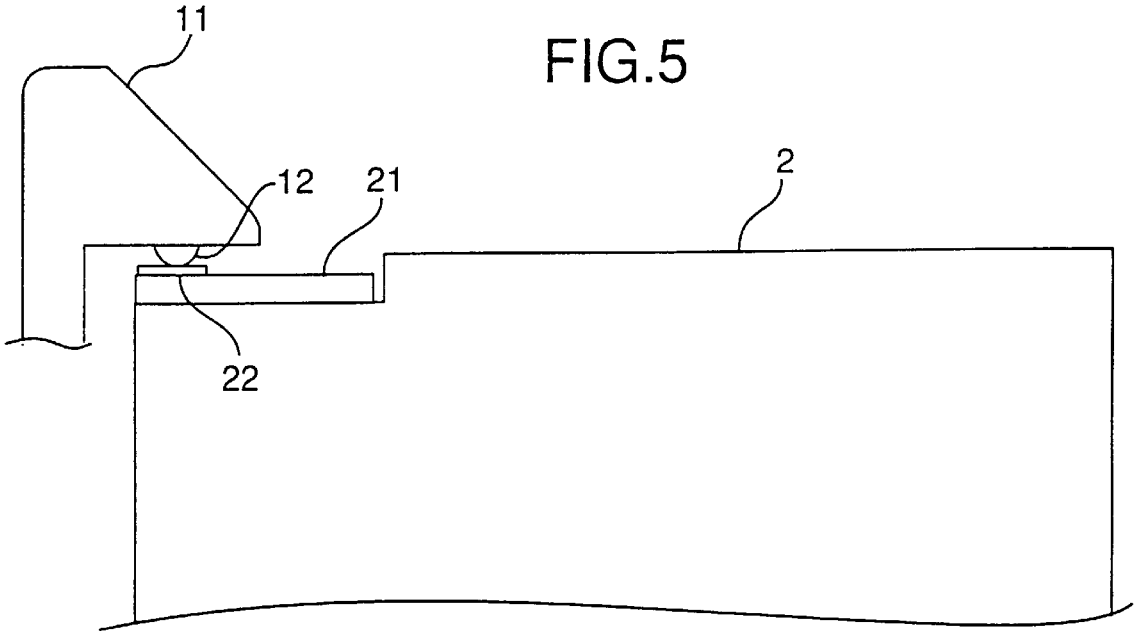
FIG. 5 shows a connection means for connecting the cartridge memory with the main body according to the present invention.

FIG. 5 shows a connection means for electrically connecting the cartridge memory with the main body when the toner bottle 2 is attached to the main body. As shown in FIG. 5, the connector part 12 in the main body is provided at a joint of a bottle supporting assembly 11 which resiliently the bottle 2 attaches to the main body. Then, the bottle 2 is supported and electrically connected to the main body through the connector part 12 in the main body and the connector part 22 in the bottle 2.

Figure 3:
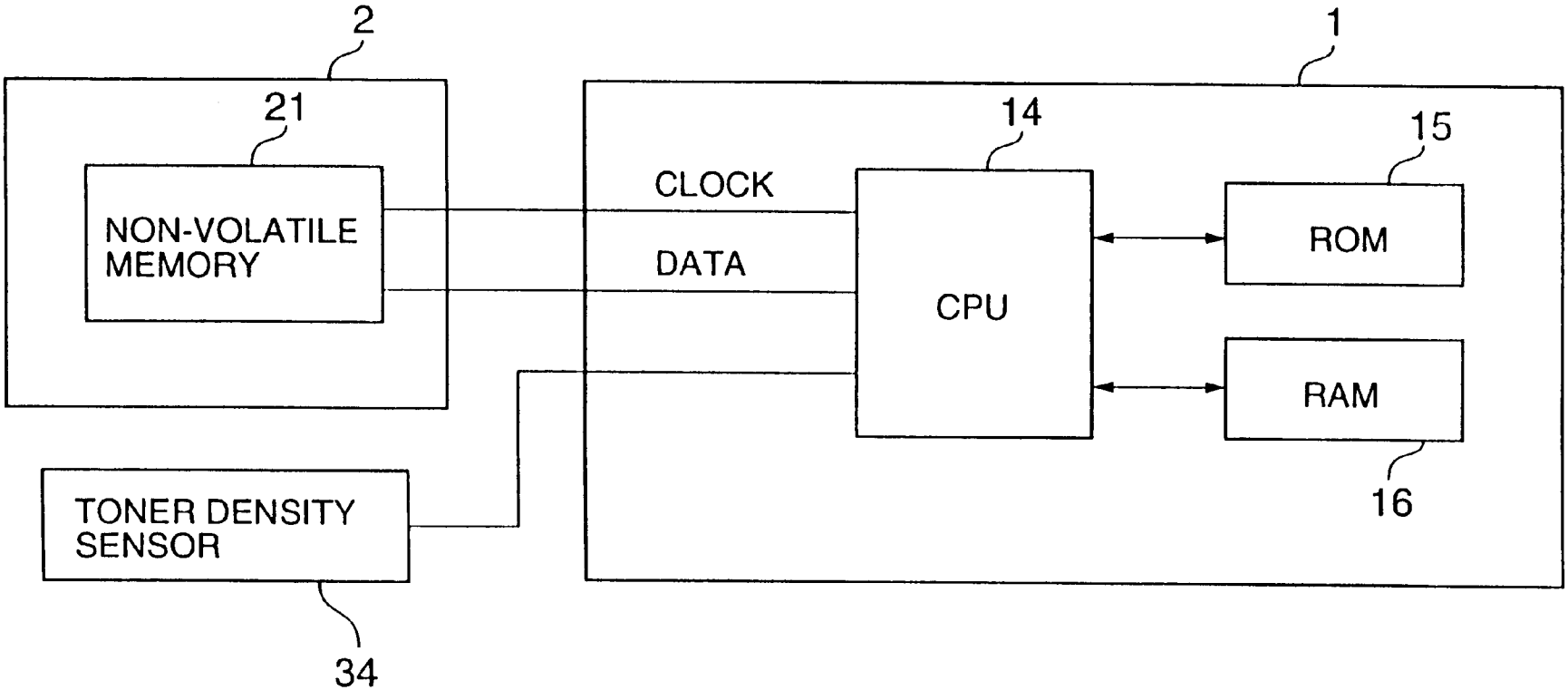
FIG. 3 shows a block diagram of a non-volatile memory (cartridge memory) attached to a toner bottle and a control unit of a main body of the image forming apparatus according to an embodiment of the present invention.

FIG. 3 shows a block diagram of the non-volatile memory (cartridge memory) attached to the toner bottle and the control unit of the main body of the image forming apparatus according to an embodiment of the present invention. As shown in FIG. 3, the toner bottle 2 has the cartridge memory 21 and the CPU 14 in the main body of the image forming apparatus 1 can read the data from of write the data to the cartridge memory 21. The CPU 14 is in charge of the control function for the entire image forming apparatus 1 and has a ROM 15 which stores a software program, data for the program and data for the control function, and a RAM 16 which serves memory for the CPU.

In this embodiment, an IC chip (memory chip) which includes the cartridge memory having the non-volatile memory (EEPROM) is connected to the CPU 14 in the main body through the $I^2C$ bus. The $I^2C$ bus is a serial communication bus which employs two wires, one for a clock line and another for a data line.

Next, an embodiment of the present invention of a means for calculating the amount of the used toner and a means for managing the information pertaining to the calculated amount of the used toner for the image forming apparatus as shown in FIGS. 1 to 5 is discussed.

The means for calculating the amount of the used toner can also calculate the amount of the unused toner without using any sensor. However, the calculated amount on the unused toner is also used as a criterion to start the detection operation of the end of the toner by means of a toner density sensor.

In this embodiment, each period for feeding toner into the development unit 3 in the main body of the image forming apparatus 1 from the toner bottle 2 is accumulated. Then, the total amount of the used toner is estimated based on the accumulated period. Therefore, the amount of the unused toner remaining in the toner bottle can be estimated. As a result, the amount of the unused toner remaining in the toner bottle is exactly estimated without using a detector for detecting the amount of unused toner in the toner bottle.

The period for feeding toner is a controlled variable for controlling the amount of the toner fed from the toner bottle 2 into the development unit in the main body. Therefore, the estimation to obtain the amount of the used (or unused) toner is performed in a control procedure using the period data for feeding toner as the controlled variable.

Figure 6:
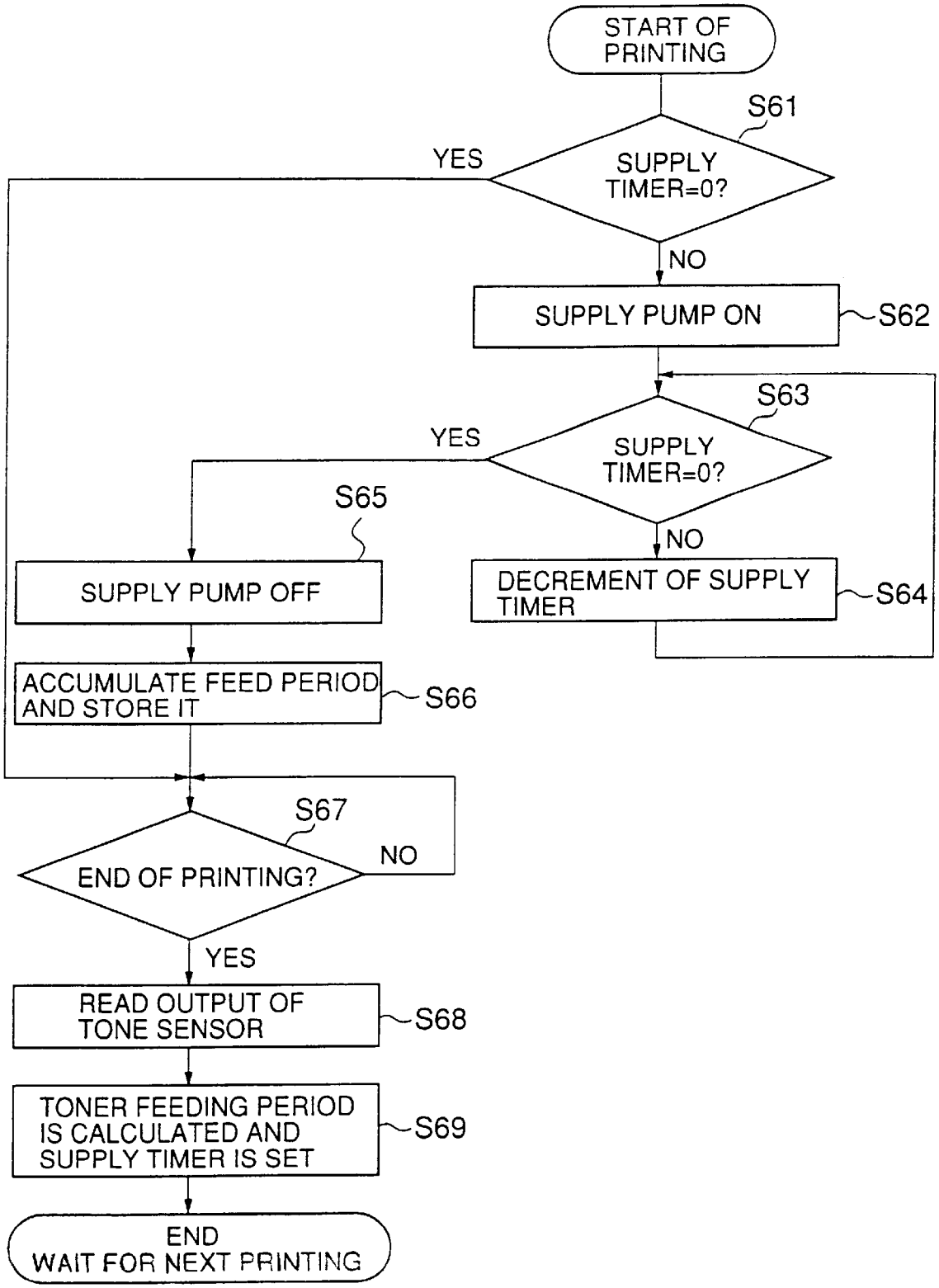
FIG. 6 shows a flow chart of a control operation for feeding the toner into the development unit in the main body according to the present invention.

FIG. 6 shows a flow chart of the control procedure for feeding the toner.

An embodiment of the control procedure will be explained with reference to FIG. 6.

This control procedure is executed every time a command to print an image on a paper is supplied, and after the whole procedure is finished, it waits for the next command.

In this procedure, first, at a step S61, it is ascertained whether a supply timer value is set to zero. This supply timer value corresponds to the amount of the toner to be fed during this print period. The supply timer value is determined based on an output value of the toner density sensor 34 at the time after the previous print operation or the development for the image for one page is finished. The detailed procedure will be explained later.

In the case that the feeding period value set in the supply timer is not zero (S61-No), at a step S62, the toner is fed into the development unit 3 by means of driving the toner supply pump 31. The amount of the toner fed into the development unit 3 is controlled based on the period during which the toner supply pump 31 is being driven. The supply timer starts decreasing its feeding period value set in the supply timer at a step S64 soon after the toner supply pump 31 starts feeding, and the toner supply pump 31 keeps feeding the toner until the feeding period value set in the supply timer becomes zero. At a step S63, the feeding period value set in the supply timer is continually checked until the feeding period value becomes zero.

When the feeding period value becomes zero (S63-YES), the toner supply pump 31 stops feeding the toner and therefore no more toner is fed into the development unit 3.

Next, the feeding period value having been used for feeding the toner is accumulated into an accumulated sum of the feeding periods and the accumulated sum is stored in the non-volatile memory. The accumulated sum of each feeding period value is proportional to the amount of the used toner. Therefore, it is required to maintain a record of this accumulated sum for each toner bottle. To meet this demand, the stored accumulated sum is read from the non-volatile memory before the bottle is used for feeding the toner, and the accumulated sum, to which the amount of the newly used toner is added, is re-written into the non-volatile memory after the feeding of the toner is finished.

It is desirable to keep the data such as the accumulated sum for each toner bottle in non-volatile memory because the data is associated with each toner bottle. Although it is possible to have such non-volatile memory in the main body of the image forming apparatus, this causes problems as follows. For example, it is required to keep track of the attached toner bottle and other bottles to properly manage the data for each bottle because the data for other bottles do not indicate the amount of the unused toner for the attached bottle. Further, the bottle is limited to use in the image forming apparatus which keeps the data for the bottle because other image forming apparatuses do not have access to the data for the bottle.

To address the problem mentioned above, according to the present invention, the IC chip having the non-volatile memory as the cartridge memory 21 is provided on the toner bottle 2. As a result, on attaching the toner bottle 2 to the image forming apparatus 1, the accumulated sum is read from the cartridge memory 21 on the toner bottle 2, and the accumulated sum, to which the amount of the newly used toner is added, is re-written into the cartridge memory 21 after the printing operation is finished. Therefore, the cartridge memory 21 can always contain the exact accumulated sum associated with the with the toner bottle 2.

Next, in FIG. 6, at the step S66, the management data such as the newly accumulated sum is re-written into the non-volatile memory. Then, when the print operation is finished (S67-YES), an output value of the toner density sensor 34 is read at a step S68. If the read output value is lower than a reference value, which is a predetermined value for controlling the amount of the toner to be fed, at the next time for printing, the amount of the toner to be fed is increased. On the other hand, if the read output value is greater than the reference value, at the next time for printing, the amount of the toner to be fed is decreased. As a result, the amount of the toner in the development unit is controlled to keep the toner density constant based on the output value of the sensor. The amount of toner fed into the development unit 3 is controlled based on the period during which the toner supply pump 31 is being driven, that is to say, the toner feeding period. Next, at a step S69, the toner feeding period is calculated and determined based on the toner density output from the toner density sensor and the determined toner feeding period is set into the supply timer and then, this procedure is terminated. For example, the determination of the toner feeding period mentioned above is performed in such a way that first, a difference between the reference value found by conducting an experiment for a certain type of apparatus and a toner density output value from the toner density sensor is determined, and then, the toner feeding period is determined according to the difference.

In case that the feeding period value in the supply timer is set to zero (S61-YES), then the supply timer is set based on the output value of the toner density sensor without executing the feeding of the toner and without performing other operations.

As mentioned above, the amount of the unused toner can be monitored without using the toner density sensor because the accumulated sum of the toner feeding periods is calculated at the step S66 and the amount of the used toner is estimated in the procedure shown in FIG. 6.

Next, another embodiment of the present invention will be explained. In the embodiment, the exact amount of the used toner is estimated even if the toner supply pump 31 has a different performance.

For example, there are many modes in which it is required to increase the printing speed at the cost of the image quality such as image resolution or in which it is required to decrease the printing speed in order to improve the image quality. Under these conditions, the amount of the toner to be fed into the development unit should be adjusted, and therefore it is required to change the speed of the toner supply pump 31 in order to print the image properly. To meet this demand, the speed of the toner supply pump 31 is changed in order to supply the proper amount of the toner.

In the case that the printing speed needs to be increased, the amount of the toner to be fed becomes inadequate if the speed of the toner supply pump 31 is kept low. Therefore, the speed of the toner supply pump 31 should be increased. However, in such case, if the relation between the feeding period value and the amount of the toner to be fed is kept unchanged, the amount of the toner to be fed will be mis-estimated. As a result, the exact amount of the toner to be fed cannot be estimated.

To address this problem, according to the present invention, the accumulated sum of the feeding periods is calculated for each speed, revolutions per minute (rpm) or each linear velocity, of the toner supply pump 31 and the calculated data is stored for each rpm or each linear velocity.

Figure 7:
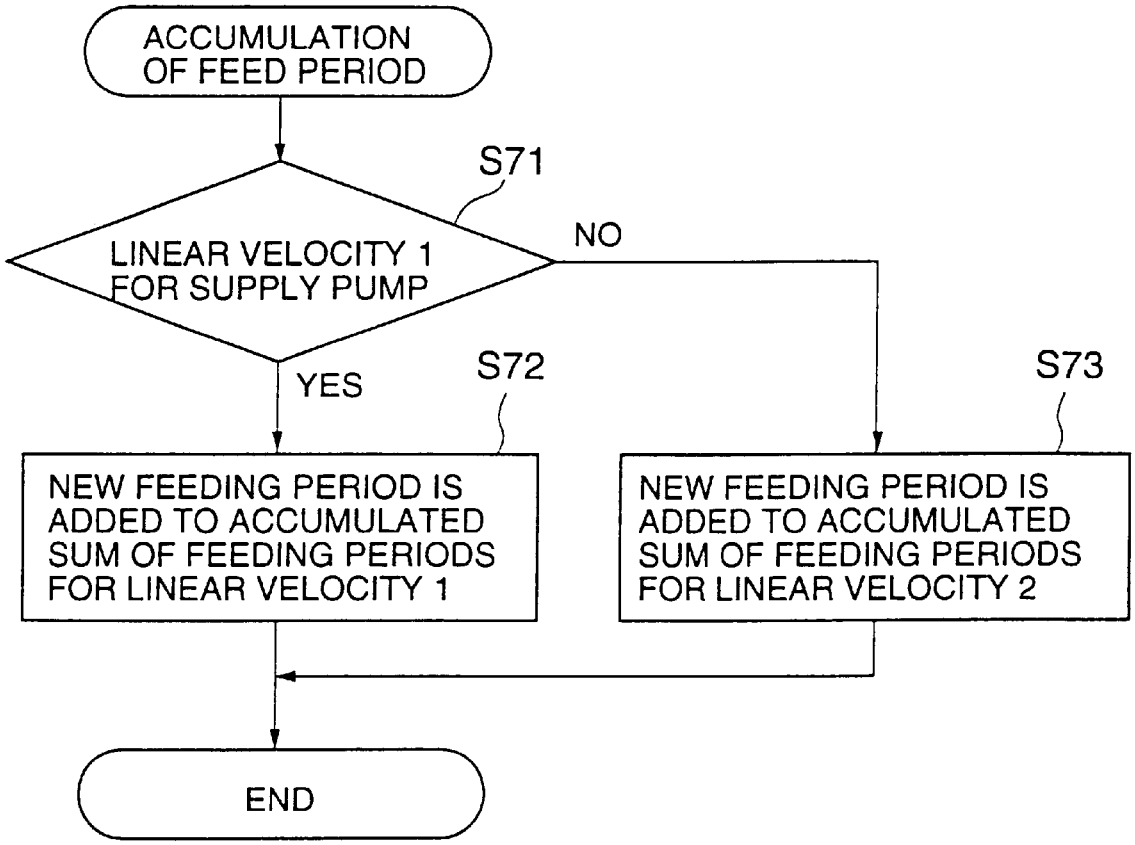
FIG. 7 shows a flow chart of an embodiment of the present invention of a procedure for accumulating each period of feeding the toner.

FIG. 7 shows a flow chart of an embodiment of a procedure for accumulating each period of feeding the toner. This procedure is used in the toner supply control procedure in the step S66 shown in FIG. 6.

In the procedure shown in FIG. 7, first, at a step S71, the linear velocity of the toner supply pump 31 is found. In this embodiment, as two linear velocities of the toner supply pump 31 are used, it is first determined which linear velocity is used. If the linear velocity is detected to be a linear velocity 1 (S71-YES), then the new feeding period value is added to the accumulated sum of the feeding periods for the linear velocity 1 at a step S72 and the new accumulated sum of the feeding periods can be calculated. On the other hand, if the linear velocity is detected to be a linear velocity 2 (S71-NO), then the new feeding period value is added to the accumulated sum of the feeding periods for the linear velocity 2 at a step S73.

As mentioned above, both the accumulated sum for the linear velocity 1 and the accumulated sum for the linear velocity 2 are stored in the non-volatile memory. As a result, the amount of the used toner and the amount of the unused toner are estimated based on the stored accumulated sums. The procedure to calculate the amount of the used toner and the amount of the unused toner will be explained later.

Further, it is possible to keep the relation between the feeding period value and the amount of the toner to be fed proportional by employing a compensation of the accumulated sum of the feeding periods based on the linear velocity of the toner supply pump 31. This compensation can integrate the two kinds of accumulated sums of the feeding period into one accumulated sum. As a result, two memory areas for storing two kinds of accumulated sums can be combined into one memory area.

Figure 8:
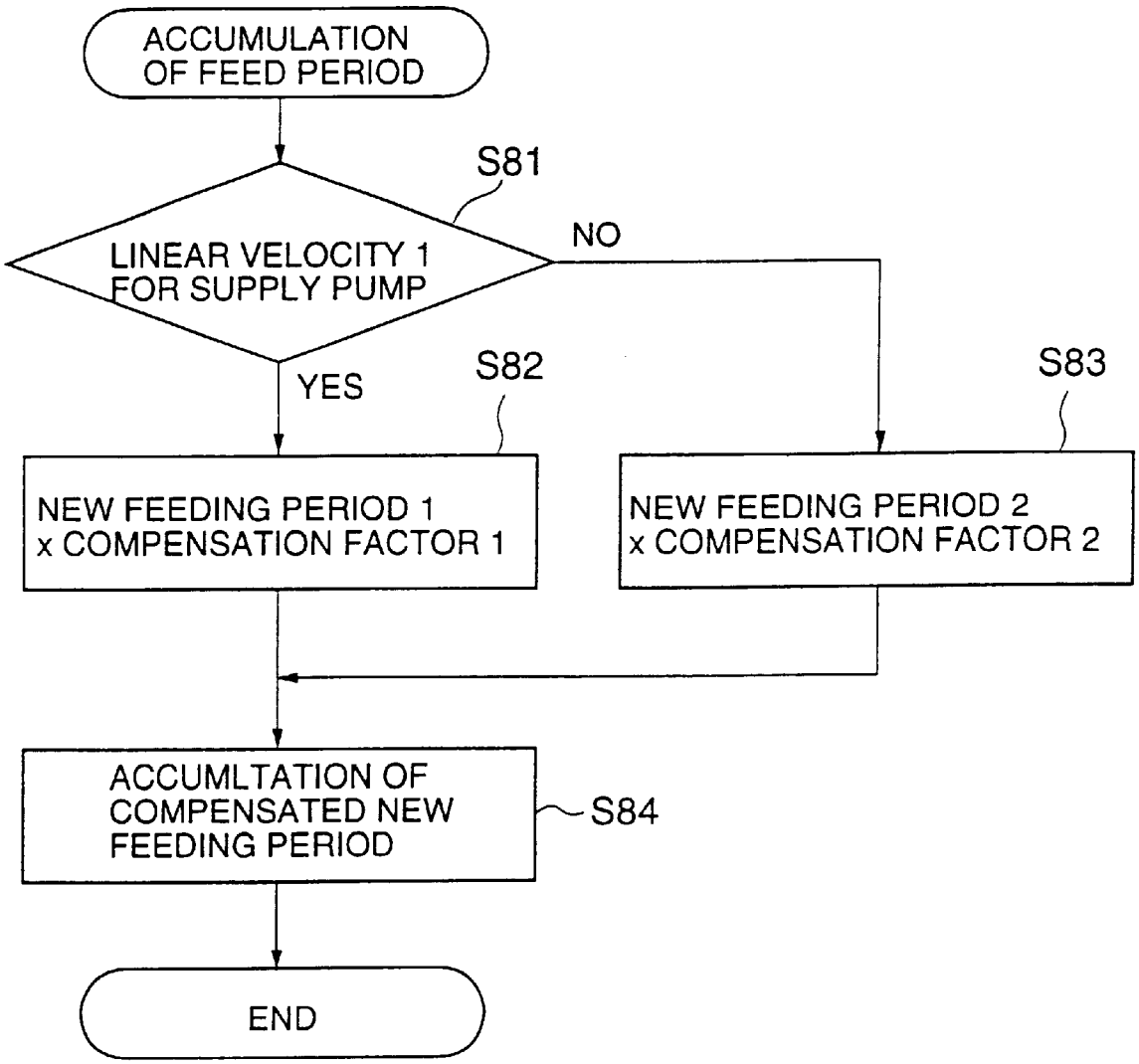
FIG. 8 shows a flow chart of another embodiment of the present invention of a procedure for accumulating each period of feeding the toner.

FIG. 8 shows a flow chart of another embodiment of a procedure for accumulating each period of feeding the toner. This procedure is used in the toner supply control procedure in the step S66 shown in FIG. 6.

In the procedure shown in FIG. 8, first, at a step S81, the linear velocity of the toner supply pump 31 is checked. In this embodiment, as two linear velocities of the toner supply pump 31 are used, it is first determined which linear velocity is used. If the linear velocity is detected to be a linear velocity 1 (S81-YES), then the new feeding period value is multiplied by a compensation factor 1 for the linear velocity 1 at a step S82. On the other hand, if the linear velocity is detected to be a linear velocity 2 (S81-NO), then the new feeding period value is multiplied by a compensation factor 2 for the linear velocity 2 at a step S83. These compensation factors are provided for integrating the two kinds of accumulated sums into one accumulated sum by weighting the feeding period values. In this embodiment, the compensation factor 1 is equal to 1 and the compensation factor 2 is equal to a value of (the rpm of the supply pump 2/the rpmof the supply pump 2). The feeding period value for the linear velocity 1 is multiplied by the compensation factor 1 and the feeding period value for the linear velocity 2 is multiplied by the compensation factor 2. It is also possible to use other compensation factors which are experimentally determined because the compensation factors may not be proportional to the rpm's.

As mentioned above, each toner feeding period value is weighted to have an equivalent value so that both feeding period values can be added to one accumulated sum. The procedure for weighting is executed at a step S84 as follows.

Total accumulated sum of the feeding periods=the accumulated sum of the feeding periods+new feeding period 1×compensation factor 1+new feeding period 2×compensation factor 2.

As a result, it is possible to estimate the management data such as the amount of the unused toner. It should be noted that the embodiment mentioned above can also be applied to the embodiment in which the non-volatile memory is the cartridge memory 21.

Next, another embodiment of the present invention is explained for estimating the amount of the used toner and the amount of the unused toner based on the accumulated sum of the feeding periods according to the relation between the accumulated sum of the feeding periods and the amount of the used toner and the amount of the unused toner.

Figure 9:
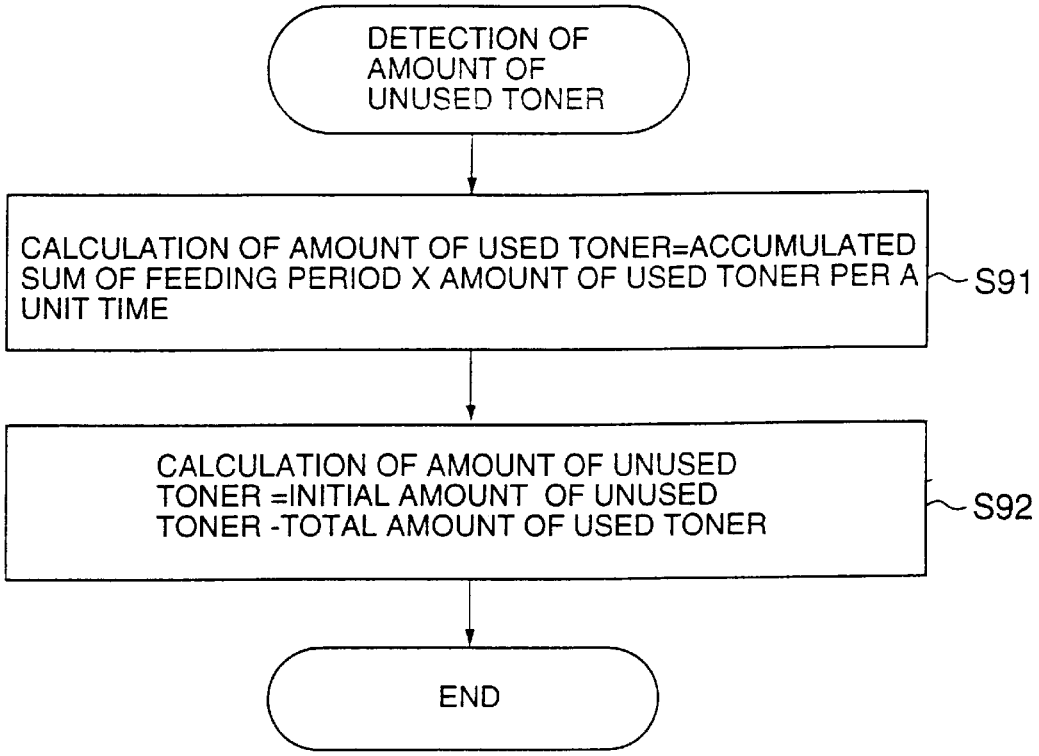
FIG. 9 shows an embodiment of the present invention of a flow chart of a procedure for calculating the amount of used toner and the amount of unused toner.

FIG. 9 shows a flow chart of a procedure for calculating the amount of the used toner and the amount of unused toner.

As shown in FIG. 9, first, at a step S91, the amount of the used toner is estimated. The accumulated sum of the toner feeding periods is a sum of each period during which the toner supply pump 31 is operating. The amount of the used toner per a unit time is dependent on the rpm of the toner supply pump 31. Therefore, the amount of the toner fed into the development unit can be calculated using both the amount of the used toner per a unit time and the accumulated sum of the feeding periods. Therefore, the total amount of the used toner can be calculated as follows:

the total amount of the used toner (g)=the accumulated sum of the feeding periods (sec.)×the amount of the used toner per a unit time (g/sec.).

The amount of the unused toner can be easily calculated from the total amount of the used toner at a step S92 as follows:

the amount of the unused toner (%)=((initial amount of the unused toner (g)−total amount of the used toner (g))/initial amount of the unused toner (g))×100.

It is desirable to store the initial amount of the unused toner (g) of the toner bottle 2 in the cartridge memory 21.

Next, another embodiment for calculating the total amount of the used toner (g) and the amount of the unused toner (%) will be explained.

This embodiment addresses the same case described above in which the rpm of the toner supply pump 31 is changed in order to supply the proper amount of the toner. In this embodiment, to meet this demand, each accumulated sum of the feeding periods (sec.) for each linear velocity of the supply pump 31 is multiplied by each compensation factor. As a result, it is possible to estimate the exact amount of the used toner even if two linear velocities of the toner supply pump 31 are employed.

Figure 10:
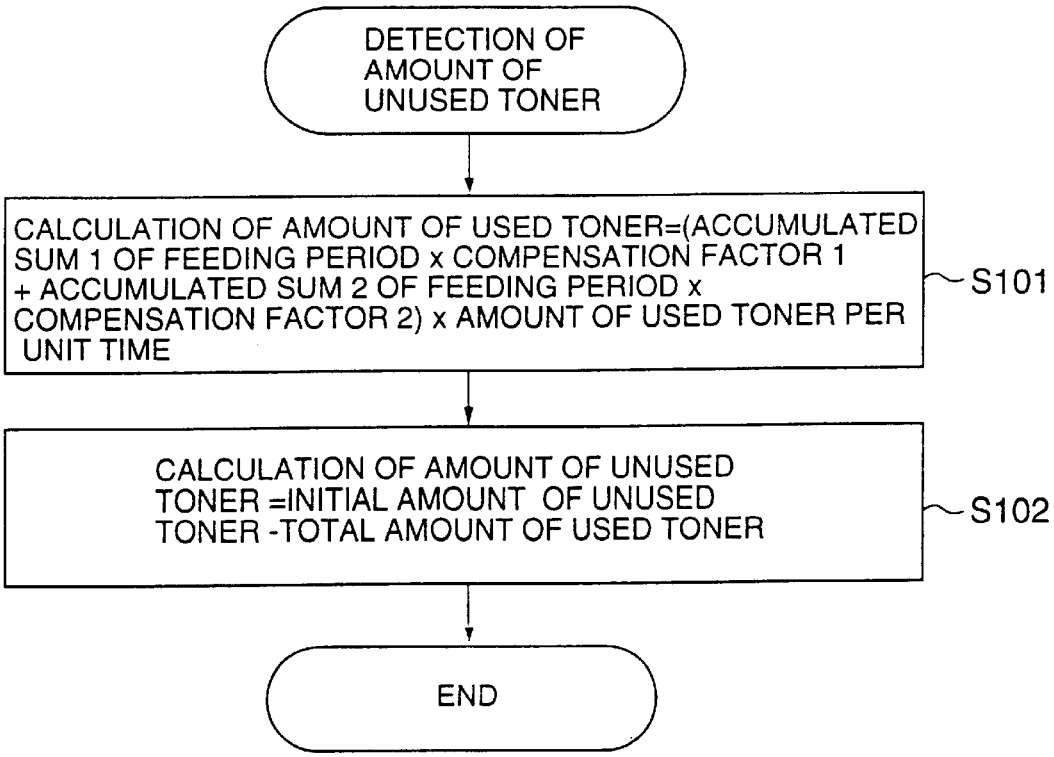
FIG. 10 shows a flow chart of another embodiment of the present invention of a procedure for calculating the amount of used toner and the amount of unused toner.

FIG. 10 shows a flow chart of this embodiment of a procedure for calculating the amount of the used toner and the amount of unused toner.

As shown in FIG. 10, first, at a step S101, the amount of the used toner is estimated.

Both the accumulated sum 1 of the feeding period for the linear velocity 1 and the accumulated sum 2 of the feeding period for the linear velocity 2 are stored. Both the compensation factor 1 and the compensation factor 2 are used to weight both the accumulated sum 1 and the accumulated sum 2 to make them to be combinable. The procedure for weighting is executed as follows:

the total accumulated sum of the feeding periods (sec.)= the accumulated sum 1 of the feeding period×the compensation factor 1+the accumulated sum 2 of the feeding period×the compensation factor 2, where the compensation factor 1=1 and the compensation factor 2=(an rpm of the supply pump 2/an rpm of the supply pump 1).

The amount of the toner fed into the development unit can be calculated using both the amount of the used toner per a unit time and the accumulated sum of the feeding periods. Therefore, the total amount of the used toner can be calculated as follows:

the total amount of the used toner (g)=the accumulated sum of the feeding periods (sec.)×the amount of the used toner per a unit time (g/sec.).

The amount of the used toner per a unit time (g/sec.) is dependent on the reference rpm of the toner supply pump 31 or the linear velocity 1.

The amount of the unused toner can be easily calculated from the total amount of the used toner at a step S102 as follows:

the amount of the unused toner (%)=((initial amount of the unused toner (g)−total amount of the used toner (g))/initial amount of the unused toner (g))×100.

It is desirable to store the initial amount of the unused toner (g) of the toner bottle 2 in the cartridge memory 21.

The amount of the used toner and the amount of the unused toner can also be stored in the non-volatile memory with the accumulated sum of the feeding periods or in place of the accumulated sum of the feeding periods.

Next, another embodiment of the present invention will be explained. In this embodiment, the accumulated sum of the feeding periods is used to delay starting the detection of the end of the toner by the toner density sensor based on using the estimated amount of the unused toner, in place of using the toner density sensor for estimsting the amount of the unused toner.

As described in the summary of the invention, in order to exactly detect an end of the toner without causing the mis-detection, the end of the toner is detected using the conventional toner density sensor 34 placed at the bottom of a toner bottle 2 after the amount of the used toner exceeds a predetermined value.

In this embodiment, the amount of the used toner to be used as a criteria to judge whether the toner density sensor 34 can be used to detect the end of the toner, corresponds to the accumulated sum of the feeding periods.

Figure 11:
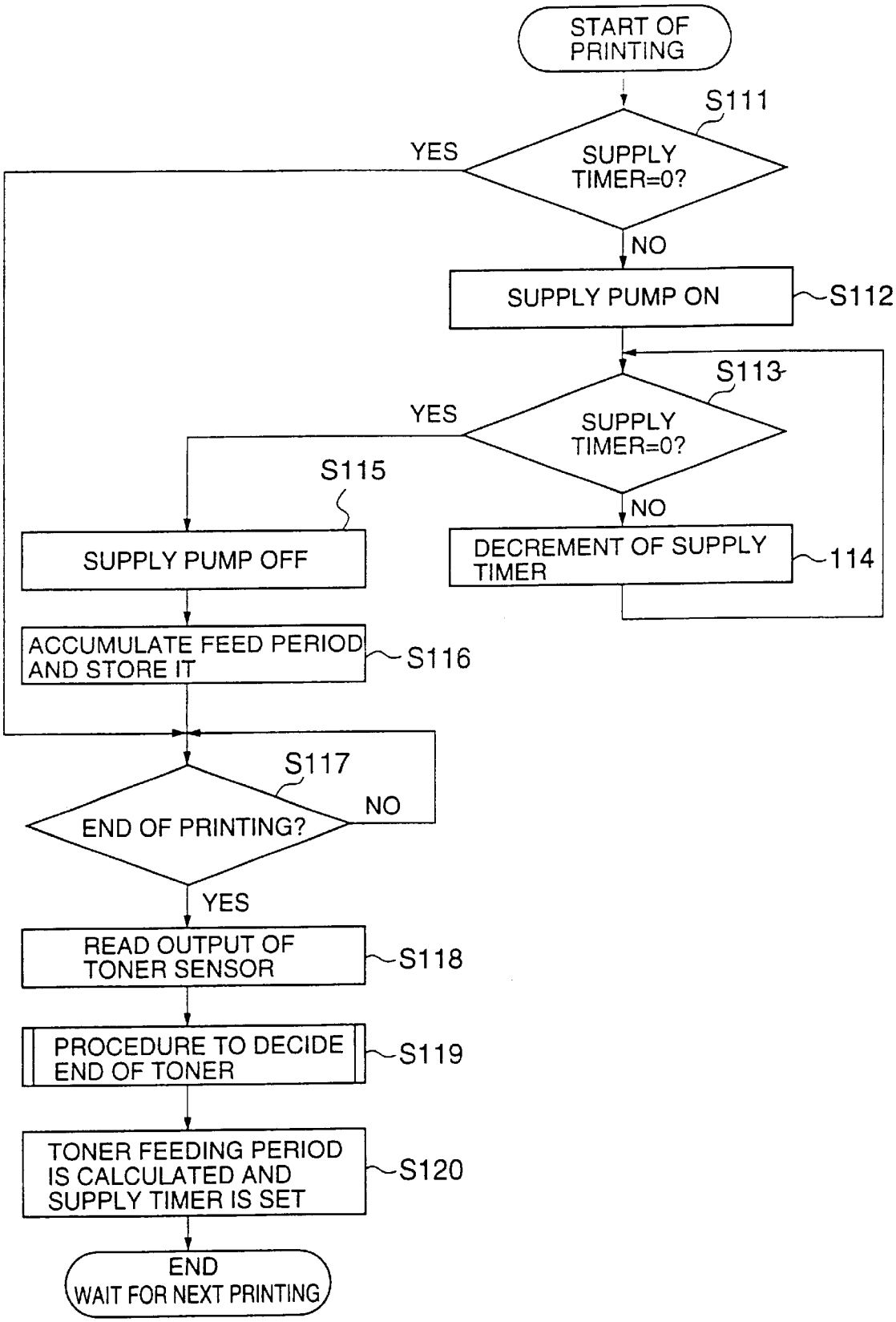
FIG. 11 shows a flow chart of an operation for feeding the toner in which the detection of the end of the toner is initiated and the calculation of the end of toner is performed, according to the present invention.

FIG. 11 shows a flow chart of an operation for feeding the toner in which the detection of the end of the toner is initiated and the calculation of the end of toner is performed.

In this embodiment, the accumulated sum of the feeding periods or the amount of the unused toner is estimated in the same toner supply control operation as described in the embodiment shown in FIG. 6. Further, a procedure to calculate the end of the toner is also performed in the toner supply control operation.

Steps shown in FIG. 11 are the same steps as those shown in FIG. 6 except for adding a step S119 for the calculation of the end of the toner. Therefor, the steps S111 to S118 shown in FIG. 11 correspond to the steps S61 to S68 shown in FIG. 6 and the step S120 shown in FIG. 11 correspond to the step S69 shown in FIG. 6. The explanation of the same steps shown in FIG. 11 as those shown in FIG. 6 are omitted.

Next, the procedure S119 shown in FIG. 11 to calculate the end of the toner will be explained.

Figure 12:
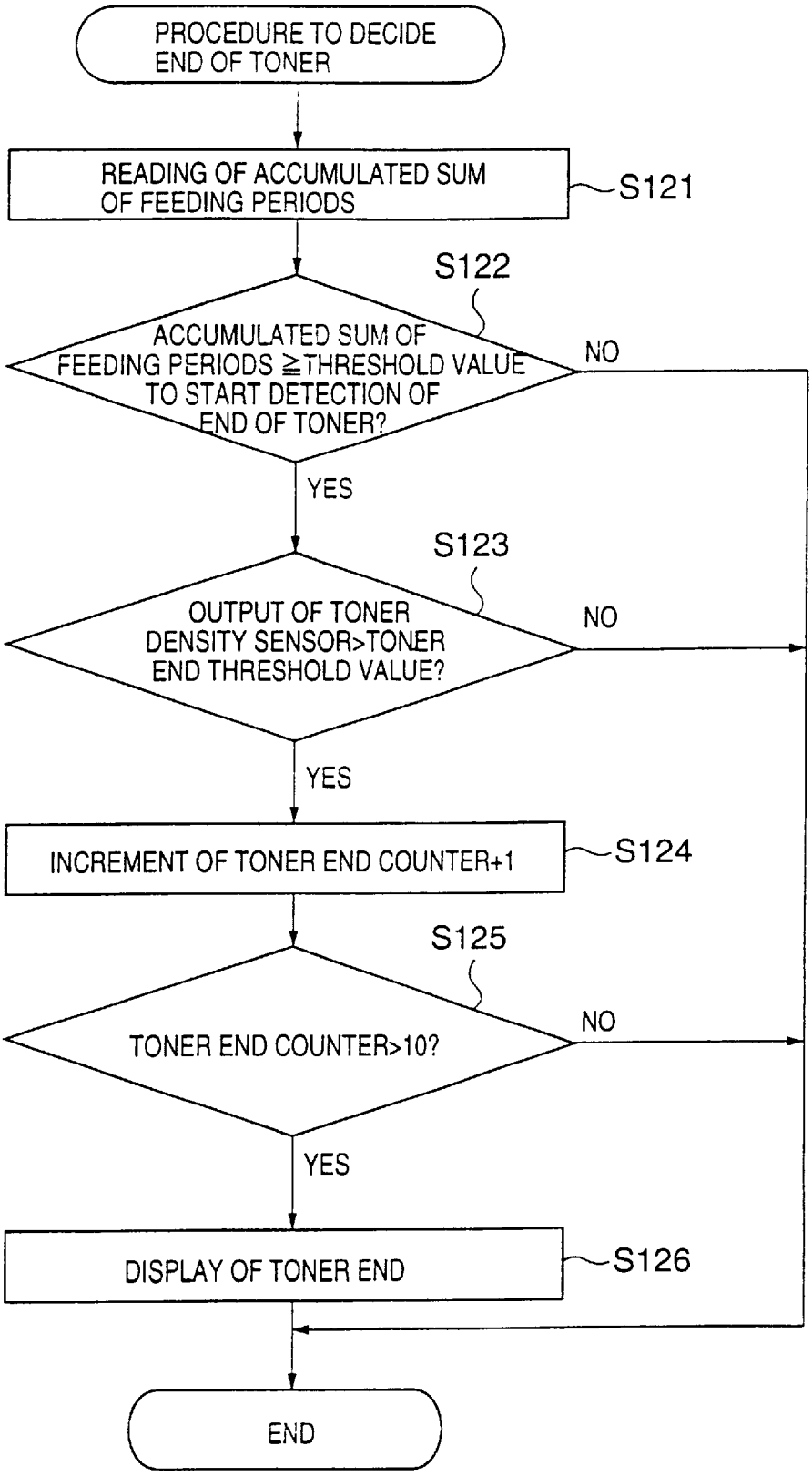
FIG. 12 shows a subroutine for the calculation of the end of toner shown in FIG. 11.
Figure 13:
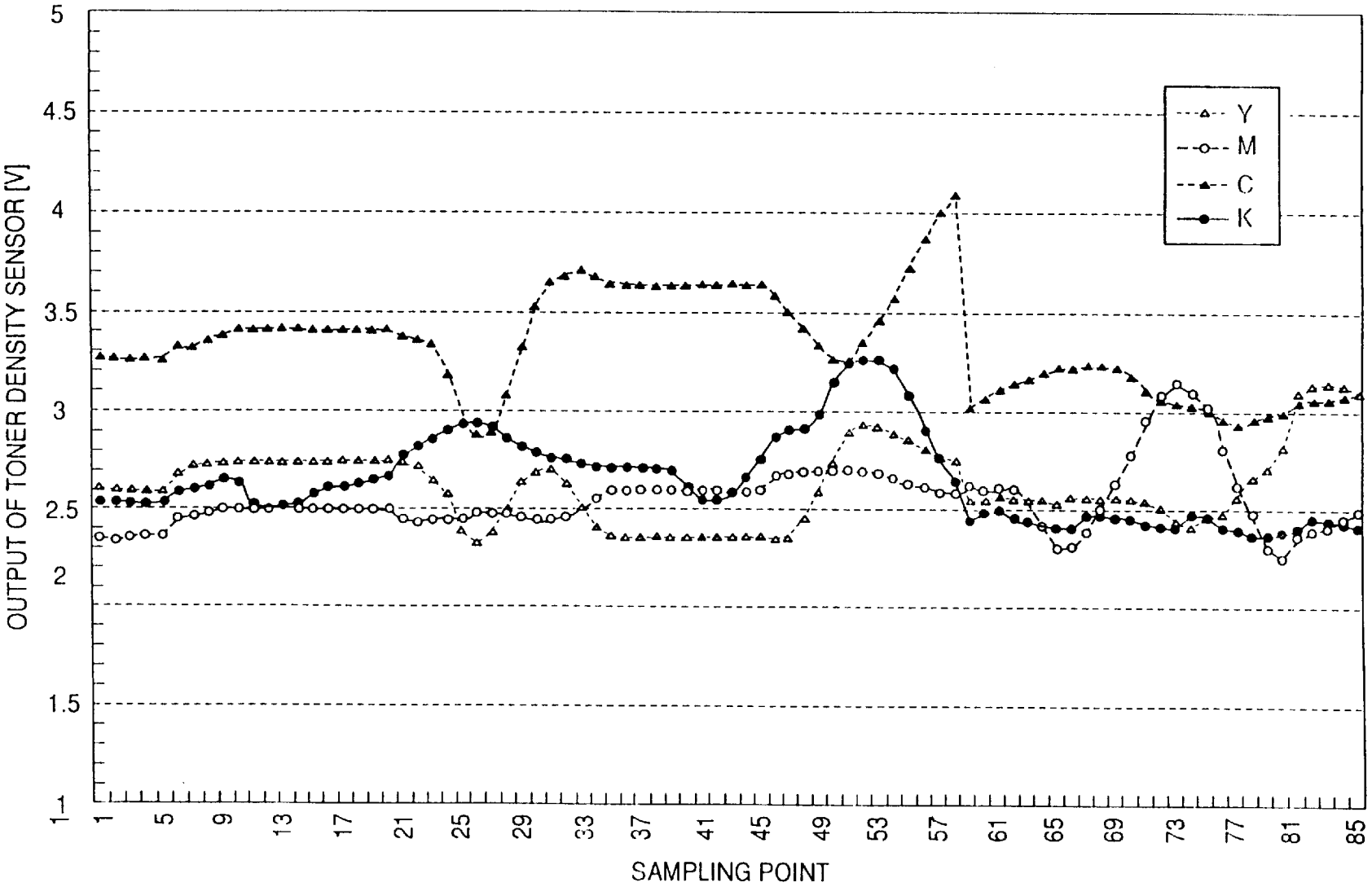
FIG. 13 shows a fluctuation of sampled density values of the sensor output under the regular operating condition of the prior art.

FIG. 12 shows a subroutine for the procedure S119 to calculate the end of toner. The step S119 mainly consists of three steps S122, S123 and S126. In the step S122, it is determined whether the detection of the end of the toner can be started. In the step S123, the output of the toner density sensor 34 is monitored. In the step S126, a result of the detection is displayed.

First, in a step S121, data of the accumulated sum of the feeding periods is read from the non-volatile memory. This data is estimated and stored at the step S116. In case that each accumulated sum of the feeding periods for each linear velocity is stored separately, as shown in FIG. 7, the accumulated sums of the feeding periods are added to each other after each accumulated sum of the feeding periods is weighted by the compensation factor for each linear velocity. On the other hand, in case that the accumulated sum of the feeding periods is stored after the accumulated sum of the feeding periods is weighted by the compensation factor for each linear velocity, the stored accumulated sum of the feeding periods can be used as it is.

Next, it is determined whether the detection of the end of the toner can be started based on the threshold values.

The detection of the end of the toner should be started before the toner is completely used. Therefore, first, a shortest period, that is, the shortest elapsed time period during which the toner is never used completely is determined. Then, the detection of the end of the toner by the toner density sensor 34 will be started just after the accumulated sum of the feeding periods exceeds the shortest period.

The shortest period can be estimated based on the performance of the toner supply pump 31. It is desirable to set the shortest period to a period during which the toner supply pump 31 feeds the toner with a maximum performance. For example, if the performance is 0.5±0.1 g/sec. at a reference rpm of the toner supply pump, the maximum rate of the amount of the supply toner at the maximum performance is 0.6 g/sec. Therefore, the shortest period is calculated as follows:

the shortest period (sec.)=initial amount of the unused toner (g)/the maximum rate 0.6 (g/sec.)

In FIG. 12, the shortest period is used as an threshold value to judge whether the detection of the end of the toner can be started. At the step S122, it is determined whether the accumulated sum of the feeding periods obtained at the step S121 becomes equal to or greater than the shortest period.

Then, (S122-YES) the detection of the end of the toner by the toner density sensor 34 will be started after the accumulated sum of the feeding periods obtained at the step S121 becomes equal to or greater than the shortest period (S122-YES).

The end of the toner is monitored using the output of the toner density sensor 34, the output of which is gradually increasing as the density of toner is gradually decreasing. When the output of the toner density sensor 34 exceeds the predetermined value, a signal which indicates the end of the toner is supplied. The toner density sensor 34 is not explained because it is well known in the prior art.

In this embodiment, at the step S123, the end of the toner is determined when the output value of the toner density sensor 34 becomes a greater value than the predetermined threshold value.

In order to avoid mis-detetion of the end of the toner, the signal which indicates the end of the toner is not yet supplied if the end of the toner is detected only once (S123-YES). However, the signal which indicates the end of the toner is supplied after the end of the toner is detected more than 10 times. At a step S124, a counter is incremented every time the end of the toner is detected at the step S123, and then, at the step S125, it is determined whether the counter value is greater than 10.

When the counter value is greater than 10 (S125-YES), it is assumed that the toner is completely used. Then, at the step S126, the end of toner is displayed to notify the users. It is also possible to display a message to call the attention of the users. It is also possible to inhibit the users from printing the images if the quality of the formed image is degraded, in order to avoid the degraded image from being printed.

In this embodiment, as shown in FIG. 12, if the accumulated sum of the feeding periods is smaller than the shortest period (S122-NO), or if the output value of the toner density sensor 34 is smaller than the predetermined threshold value (S123-NO), or if the counter value is smaller than 10 (S125-NO), then the procedure proceeds to the step S120 in the main routine as shown in FIG. 11.

In the embodiment described above, the color image forming apparatus is used to explain the embodiment. However, it is apparent to those who are skilled in the art that the present invention is applied to a grayscale image printing apparatus.

In the embodiment described above, the replacement assembly is described as the toner bottle or toner cartridge. However, it is apparent to those who are skilled in the art that the replacement assembly can be constructed by a combination of the toner bottle and the development unit, and a combination of the toner bottle, the development unit and the photosensitive unit.

The present invention is not limited to the specifically disclosed embodiments, and variations and modifications may be made without departing from the scope of the present invention.

The present application is based on Japanese priority application No. 2000-394988 filed on Dec. 26, 2000, Japanese priority application No. 2000-394990 filed on Dec. 26, 2000 and Japanese priority application No. 2001-369812 filed on Dec. 04, 2001, the entire contents of which are hereby incorporated by reference.

What is claimed is:

1. An electro photographic image forming apparatus comprising:

a replacement assembly having a toner container attachable to said image forming apparatus;

a feeding unit to feed toner from said toner container to a development unit;

a toner detection unit which detects a density of the toner in said development unit and detects that the toner is used completely in said toner container; and a read/write non-volatile memory;

wherein, said image forming apparatus comprising:

an estimation unit which generates information in such a way that first, said estimation unit obtains an amount of toner feed periods for said feeding unit during forming images, next, accumulates said amount of the toner feed periods into an accumulated sum of said amount of toner feed periods, then stores said accumulated sum into said read/write non-volatile memory and makes said toner detection unit start detecting the amount of the toner contained in said toner container after said accumulated sum exceeds a predetermined value.

2. The image forming apparatus as claimed in claim 1, wherein said image forming apparatus is able to operate under a plurality of image forming conditions, when a linear velocity for feeding the toner is changed according to said image forming condition, said estimation unit compensates said amount of said toner feed period during forming images according to said changed linear velocity.

3. The image forming apparatus as claimed in claim 2 wherein said estimation unit separately stores each accumulated sum for each linear velocity into said read/write non-volatile memory.

4. The image forming apparatus as claimed in claim 3, wherein said estimation unit calculates a sole accumulated sum from a plurality of said compensated amounts of the feed period for a plurality of linear velocities.

5. The image forming apparatus as claimed in claim 4, wherein said read/write non-volatile memory is placed in said replacement assembly.

6. The image forming apparatus as claimed in claim 3, wherein said read/write non-volatile memory is placed in said replacement assembly.

7. The image forming apparatus as claimed in claim 2, wherein said estimation unit calculates a sole accumulated sum from a plurality of said compensated amounts of the feed period for a plurality of linear velocities.

8. The image forming apparatus as claimed in claim 7, wherein said read/write non-volatile memory is placed in said replacement assembly.

9. The image forming apparatus as claimed in claim 3, wherein said read/write non-volatile memory is placed in said replacement assembly.

10. The image forming apparatus as claimed in claim 1, wherein said read/write non-volatile memory is placed in said replacement assembly.

11. An electro photographic image forming apparatus comprising:

a replacement assembly having a toner container attachable to said image forming apparatus;

a feeding unit to feed toner from said toner container to a development unit; and a read/write non-volatile memory;

wherein, said image forming apparatus comprising:

an estimation unit which generates information in such way that first, said estimation unit obtains an amount of toner feed periods for said feeding unit during forming images, next, accumulates said amount of the toner feed periods into an accumulated sum of said amount of toner feed periods, then, generates said information on the amount of toner in said replacement assembly and stores said information into said read/write non-volatile memory, wherein said image forming apparatus is able to operate under a plurality of image forming conditions, when a linear velocity for feeding the toner is changed according to said image forming condition, said estimation unit compensates said amount of said toner feed periods during forming images according to said changed linear velocity.

12. The image forming apparatus as claimed in claim 11 wherein said estimation unit separately stores each accumulated sum for each linear velocity into said read/write non-volatile memory.

13. The image forming apparatus as claimed in claim 12, wherein said estimation unit calculates a sole accumulated sum from a plurality of said compensated amounts of the feed period for a plurality of linear velocities.

14. The image forming apparatus as claimed in claim 13, wherein said read/write non-volatile memory is placed in said replacement assembly.

15. The image forming apparatus as claimed in claim 12, wherein said read/write non-volatile memory is placed in said replacement assembly.

16. The image forming apparatus as claimed in claim 11, wherein said estimation unit calculates a sole accumulated sum from a plurality of said compensated amounts of the feed period for a plurality of linear velocities.

17. The image forming apparatus as claimed in claim 16, wherein said read/write non-volatile memory is placed in said replacement assembly.

18. The image forming apparatus as claimed in claim 11, wherein said read/write non-volatile memory is placed in said replacement assembly.

19. An IC chip attachable to an electro photographic image forming apparatus, said IC chip having a read/write non-volatile memory which is connected to a CPU in said electro photographic image forming apparatus when said IC chip is attached to said electro photographic image forming apparatus and is controlled by said CPU, wherein an accumulated sum of an amount of toner feed periods during which toner is supplied from a toner container to a development unit in said image forming apparatus is stored into said read/write non-volatile memory, said accumulated sum is read from said read/write non-volatile memory when said IC chip is attached to said image forming apparatus, said accumulated sum read from said read/write non-volatile memory is transferred to a main body of said image forming apparatus, a new accumulated sum of said amount of the toner feed periods is calculated based on the time intervals the toner is supplied from a toner container to a development unit in said image forming apparatus, said new accumulated sum is rewritten over said accumulated sum which is already stored in said read/write non-volatile memory; and wherein said IC chip separately stores each accumulated sum for each linear velocity into said read/write non-volatile memory.

20. A replacement assembly having a toner container attachable to said image forming apparatus comprising said IC chip as claimed in claim 19.

* * * * *